US009283768B2

(12) United States Patent
Akahane

(10) Patent No.: US 9,283,768 B2
(45) Date of Patent: Mar. 15, 2016

(54) LIQUID EJECTING APPARATUS

(71) Applicant: SEIKO EPSON CORPORATION, Tokyo (JP)

(72) Inventor: Fujio Akahane, Nagano (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 13/717,163

(22) Filed: Dec. 17, 2012

(65) Prior Publication Data

US 2013/0162719 A1 Jun. 27, 2013

Related U.S. Application Data

(63) Continuation of application No. 12/504,353, filed on Jul. 16, 2009, now Pat. No. 8,342,653, which is a continuation of application No. 11/472,313, filed on Jun. 22, 2006, now Pat. No. 7,578,578.

(30) Foreign Application Priority Data

Jun. 23, 2005 (JP) ..... 2005-182970

(51) Int. Cl.
*B41J 2/21* (2006.01)
*B41J 2/145* (2006.01)

(52) U.S. Cl.
CPC ..... *B41J 2/2135* (2013.01); *B41J 2/145* (2013.01)

(58) Field of Classification Search
None
See application file for complete search history.

(56) References Cited

U.S. PATENT DOCUMENTS

| | | | | |
|---|---|---|---|---|
| 5,696,541 | A | 12/1997 | Akahane et al. | |
| 5,806,996 | A | 9/1998 | Leys et al. | |
| 6,033,060 | A | 3/2000 | Minami | |
| 2002/0024554 | A1 | 2/2002 | Tominaga | |
| 2002/0024557 | A1 * | 2/2002 | Matsumoto et al. | 347/42 |
| 2004/0179062 | A1 * | 9/2004 | Rai et al. | 347/42 |
| 2005/0206678 | A1 * | 9/2005 | Nishino | 347/43 |
| 2005/0259128 | A1 * | 11/2005 | Kusunoki | 347/42 |

FOREIGN PATENT DOCUMENTS

| | | | |
|---|---|---|---|
| JP | 04052147 | A | 2/1992 |
| JP | 07-314851 | | 12/1995 |
| JP | 10052930 | A | 2/1998 |
| JP | 2002-019097 | | 1/2002 |
| JP | 2004-90493 | A | 3/2004 |
| JP | 2004-90494 | A | 3/2004 |
| JP | 2004090494 | A * | 3/2004 |
| JP | 2004-276394 | A | 10/2004 |

OTHER PUBLICATIONS

Machine translation of JP 2004-276394 A. (JP 2004-276394 A was published on Oct. 7, 2004.).*
Machine translation of JP 2004-090494 A. (JP 2004-090494 A was published on Mar. 25, 2004.).*
Translation of JP 2004-276394. (JP 2004-276394 was published on Oct. 7, 2004.).*

* cited by examiner

*Primary Examiner* — Justin Seo
(74) *Attorney, Agent, or Firm* — Sughrue Mion, PLLC

(57) ABSTRACT

A head unit is configured to be attached to a base and includes: a nozzle array group including a plurality of nozzle arrays each of which is defined by a plurality of nozzles that are arranged in a first direction and which are arranged in a second direction orthogonal to the first direction; and two correctors configured to adjust an angle of the plurality of nozzle arrays with respect to the base, one of the correctors disposed outside of the nozzle array group in the second direction.

12 Claims, 12 Drawing Sheets

LIQUID EJECTING APPARATUS

CROSS-REFERENCE TO RELATED APPLICATIONS

This is a Continuation of application Ser. No. 12/504,353 filed Jul. 16, 2009 which is Continuation of application Ser. No. 11/472,313 filed Jun. 22, 2006, now U.S. Pat. No. 7,578,578, issued Aug. 25, 2009, which claims priority from Japanese Patent Application No. 2005-182970, filed in the Japan Patent Office on Jun. 23, 2005. The entire disclosures of the above-named applications are incorporated herein by reference in their entireties.

BACKGROUND OF THE INVENTION

The present invention relates to a liquid ejecting apparatus which ejects a liquid supplied from a liquid cartridge or the like as liquid droplets, and particularly to a liquid ejecting apparatus equipped with an ejecting head position adjustment mechanism.

As one kind of liquid ejecting apparatus, there is an inkjet recording apparatus. Such an inkjet recording apparatus has an advantage that it is possible to print directly on a recording medium and, what is more, it is easy to reduce the size of a head, and furthermore that a color printing can easily be carried out by changing ink colors. However, in the event that a plurality of inkjet heads or printhead cartridges are mounted on an identical carriage, due to a mechanical tolerance which each head has and an attaching tolerance, relative positions of nozzles are deviated relative to their ideal positions, whereby a satisfactory printing quality cannot be obtained.

Particularly, in a printhead cartridge having an ink cartridge and a head integrally configured, since a head is also replaced when an ink is ran out, it is necessary to adjust the heads each time. However, since it is not possible to force a user to work on the adjustment, a result of a test printing is read by a sensor, and a cam is driven by an actuator to adjust the relative positions of the heads. However, this adjustment method has a problem in which it naturally leads to a complicated configuration and an adjustment operation is necessitated on each occasion of head replacement.

At this point, as an inkjet recording apparatus equipped with a head position adjustment mechanism, ones shown in JP-A-7-314851 and JP-A-2002-19097 are disclosed.

The apparatus shown in JP-A-7-314851 is one which is configured to be able to adjust the relative positions of two recording heads, in which positioning of the two recording heads in a scanning direction is carried out by engaging them in respective head guide grooves of a carriage, while positioning of the recording heads in a paper feed direction is carried out by bringing them in close with a head positioning surface by means of a spring. Furthermore, an adjustment plate is attached to one of the recording heads with reference to the other recording head, thereby adjusting a deviation of the two recording heads from each other.

The apparatus shown in JP-A-2002-19097 includes: a nozzle unit which has a plurality of nozzles; a sub-carriage on which a plurality of the nozzle units can be integrally fixed; and a carriage which has the sub-carriage mounted thereon and can slide in a main scanning direction, in which a cam mechanism is adopted as a tilt adjustment section which adjusts a tilt of the sub-carriage in a yawing direction with respect to the main scanning direction.

In order to realize a high-speed printing, an increase in the number of nozzles of a head unit has been considered. In such a head unit, one unit head is configured by arranging a plurality of unit heads.

FIG. 12 shows an example of a head unit 60 configured by arranging a plurality of ejecting heads 61. In this example, a configuration is such that two ejecting heads 61 including four nozzle arrays 62 are arranged in a main scanning direction X. Such a head unit 60, being mounted on a not-shown carriage, reciprocates in the main scanning direction X, and ejects ink droplets from nozzles configuring each nozzle array 62 while feeding a recording medium toward a sub-scanning direction Y, thereby forming an image on the recording medium using a dot matrix. Consequently, it is necessary that the plurality of ejecting heads 61 are accurately positioned.

Regarding the relative positions of the two ejecting heads 61, since a deviation in the X direction can be electrically corrected by a method such as delaying an ejection timing, no practical issue arises even in the event that an adjustment of accuracy is not so strictly carried out. However, as a deviation in the Y direction, which is a paper feed direction, cannot be electrically corrected, physical attachment positions need to be aligned with high accuracy. In such a Y direction positioning, it is necessary that (1) the ejecting heads 61 are aligned so that a Y direction tilt of the nozzle arrays 62 is made parallel to the Y direction, and thereafter (2) the ejecting heads 61 are adjusted with respect to each other as to their absolute position accuracy in the Y direction.

In the related art described heretofore, regarding both a tilt of nozzle arrays and an absolute position of an ejecting head, such as described heretofore, a highly accurate positioning cannot be realized by a simple structure and operation.

SUMMARY

It is therefore an object of the invention to provide a liquid ejecting apparatus which realizes a highly accurate positioning, by a simple structure and operation, both a tilt of nozzle arrays and an absolute position of an ejecting head.

In order to achieve the object, according to the invention, there is provided a liquid ejecting apparatus comprising:

at least one liquid ejecting head having:

a nozzle surface, formed with a nozzle array which is operable to eject liquid toward a target medium and extends in a first direction;

a reference surface, perpendicular to the nozzle surface; and two correctors, arranged side by side with a predetermined distance and brought into contact with the reference surface.

The reference surface may extend in a second direction perpendicular to the first direction, and the correctors may be arranged in the second direction.

The liquid ejecting apparatus may further includes a transporter, operable to transport the medium relative to the liquid ejecting head in the first direction.

The reference surface may extend in the first direction, and the correctors may be arranged in the first direction.

The liquid ejecting apparatus may include a plurality of the liquid ejecting heads.

The corrector may include a cam member having a plurality of cam faces, and a positioning member adapted to position the cam member so that one of the cam faces is opposed to the reference surface, and a first distance from first one of the cam faces to a center of the cam member may be different from a second distance from second one of the cam faces to the center of the cam member.

The positioning member may include a polygonal projection having the same number of faces as the number of the cam faces, and a fitting recess in which the polygonal projection is fitted.

A shape of the fitting recess may be substantially identical with a shape of the polygonal projection.

Each cam face may have an arc shape, a center of which is identical with a center of the polygonal projection.

The cam faces may include a first cam face and a second cam face, a distance between the first cam face to the center of the cam member may be greater than a distance between the second cam face to the center of the cam member, and in a case where the second cam face is brought into contact with the reference surface, the first cam face is kept off the reference surface.

DETAIL DESCRIPTION OF PREFERRED EMBODIMENTS

An embodiment of the invention will be described in detail below.

Figure 1:
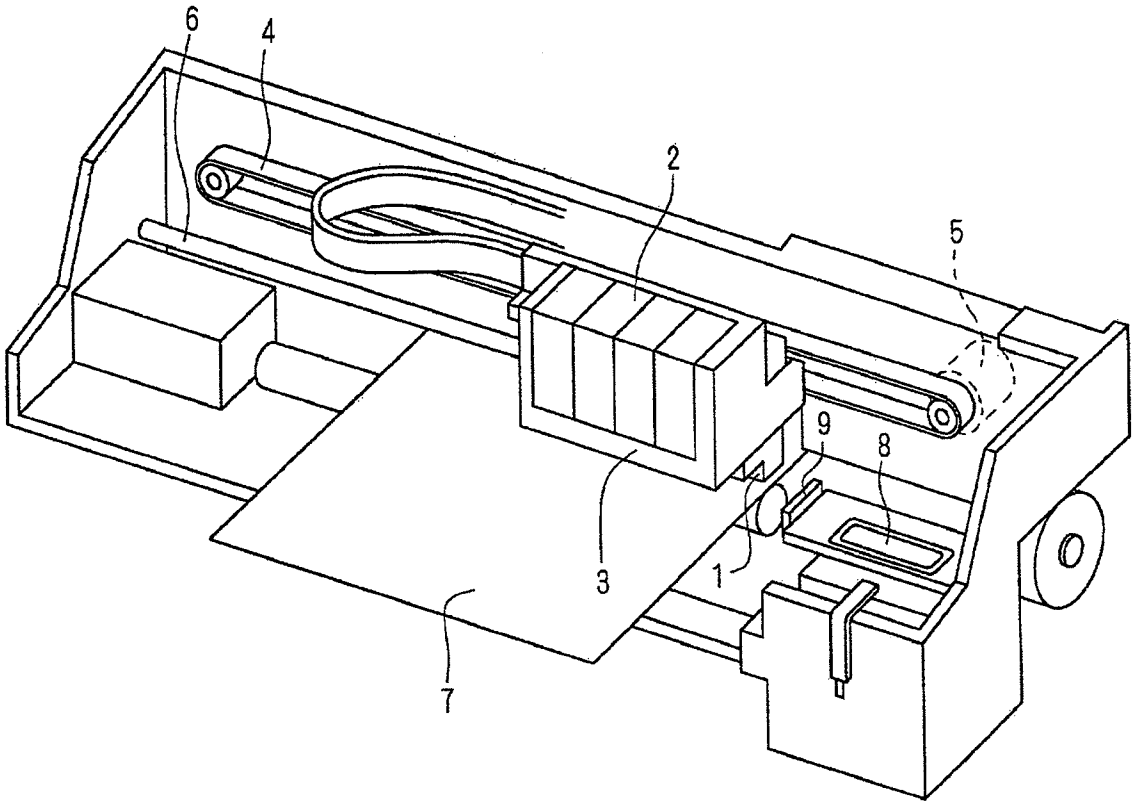
FIG. 1 is a schematic configuration diagram showing an example of a recording apparatus to which the invention is applied.

FIG. 1 is a view showing an example of a peripheral structure of an inkjet recording apparatus applying the liquid ejecting apparatus of the invention.

The apparatus includes a carriage 3 on the top of which an ink cartridge 2 serving as a liquid supply source is mounted and to the underside of which a head unit 1 ejecting ink droplets is attached.

The carriage 3, being connected to a stepping motor 5 via a timing belt 4, is configured in such a way as to, while being guided by a guide bar 6, reciprocate in a paper width direction of a recording paper 7 serving as a target object. Also, the head unit 1 is attached to a surface (in this example, the underside) of the carriage 3 facing the recording paper 7. The head unit 1, having attached thereto a plurality of ejecting heads, each of which is supplied with ink from the ink cartridge 2, is configured in such a way as to, as the recording paper 7 is transported in a transport direction (a Y direction to be described hereafter) while the carriage 3 is being moved, eject ink droplets onto an upper surface of the recording paper 7, thereby printing an image and a character on the recording paper 7 using a dot matrix.

In the figure, reference numeral 8 depicts a capping device 8, provided in a nonprinting area within a moving range of the carriage 3, which, by sealing nozzles of the head unit 1 during a cessation of printing, prevents nozzle orifices insofar as possible from drying. Also, the capping device 8 is configured in such a way as to, by applying a negative pressure to the inside of a cap by means of a suction pump, compulsorily suck ink from the nozzles and recover the clogged nozzle orifices. Furthermore, reference numeral 9 depicts a wiping device 9 which wipes a nozzle surface of the ejecting heads after the suction.

Figure 2:
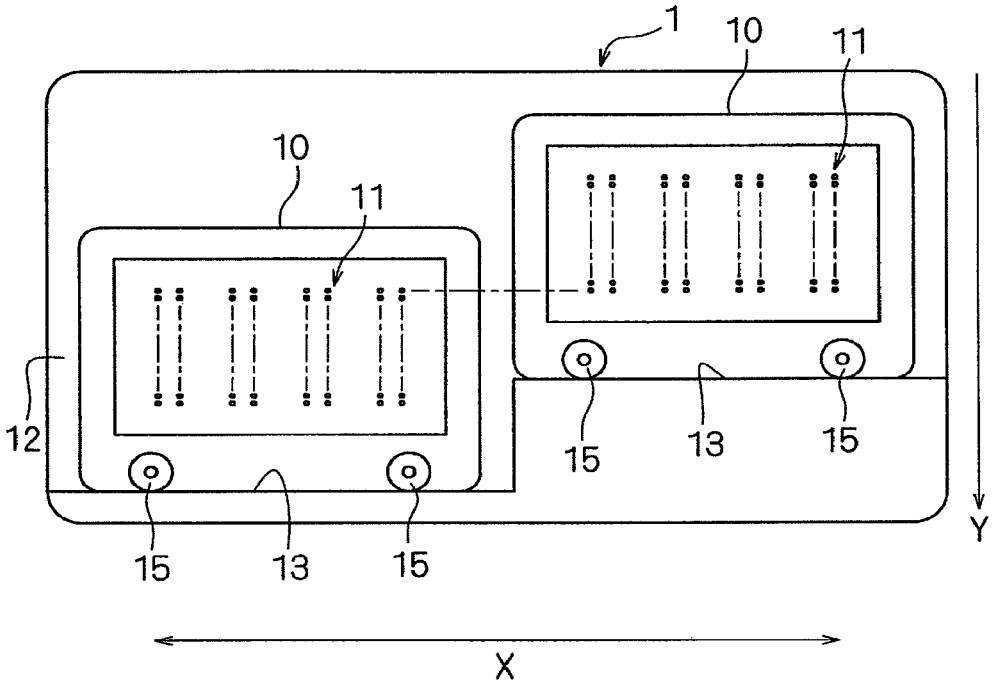
FIG. 2 is a schematic configuration diagram showing a head unit.

FIG. 2 is a view of the head unit 1 seen from the nozzle surface side.

The head unit 1 includes a plurality of (in this example, two) ejecting heads 10. Also, the ejecting heads 10 are each formed with a nozzle array 11 having a prescribed number of nozzles from which ink is ejected. In this example, eight nozzle arrays 11, formed in each of the nozzle heads 10, are each configured in such a way as to eject a different color ink. In each of the ejecting heads 10, the nozzle arrays 11 are disposed along a Y direction, and the plurality of ejecting heads 10 is disposed side by side in a paper width direction (an X direction) perpendicular to the nozzle arrays 11.

The nozzle arrays 11 each have the nozzles arrayed at a pitch P corresponding to a prescribed resolution (dot pitch). The plurality of (in this example, two) ejecting heads 10 are staggered in the Y direction by a length of the nozzle arrays 11, wherein the overall configuration of the head unit 1 is such that the nozzle arrays 11 are arrayed, two for each color, in the transport direction of the recording paper 7 (Y direction). That is, each of the ejecting heads 10 is disposed with its position determined in such a way that a paper feed direction distance, between a nozzle provided at an ejecting head 10 end and a nozzle provided at the adjacent ejecting head 10 end, is the pitch P corresponding to the dot pitch.

The nozzle surface of the ejecting heads 10 faces the recording paper 7, and ink is ejected from necessary nozzles in response to image information, thereby recording an image corresponding to the image information on the recording paper 7. At this time, ink is ejected from two nozzle arrays 11 during one stroke of the head unit 1 in the X direction, thus enabling a high speed printing.

In the head unit 1, two eccentric cam members 15, which are used to correct the position of each ejecting head 10 by being brought into with a prescribed reference surface 13, are provided side by side on the side of one side surface of the ejecting head 10, spaced with a prescribed distance. The two eccentric cam members 15 thus enable a positioning of the nozzles in a nozzle surface direction.

In this example, the head unit 1 is provided with two ejecting heads 10, and the ejecting heads 10 configuring the head unit 1 are each provided with two eccentric cam members 15. In the head unit 1, a base member 12 to which the ejecting heads 10 are attached is provided with two reference surfaces 13 corresponding to the two respective ejecting heads 10. The two reference surfaces 13, set so as to be parallel to the X direction, are formed to be staggered in the Y direction by a distance obtained by adding the length of the nozzle arrays 11 and one pitch P.

As well as each of the ejecting heads 10 being urged toward the reference surface 13 by means of not-shown urging means, the two eccentric cam members 15 are provided in line on the side of a side surface of each ejecting head 10 extending in the X direction perpendicular to the transport direction of the recording paper 7 (Y direction), and are brought into with the reference surface 13 parallel to the X direction, thereby enabling a correction of the position of the ejecting head 10 in the transport direction of the recording paper 7 (Y direction). That is, the right and left positions of the ejecting head 10 in the Y direction are adjusted by means of the two eccentric cam members 15, whereby it is possible to adjust a gradient angle of the nozzle arrays 11 with respect to the Y direction and an absolute position thereof in the Y direction. This makes it possible to maintain a Y direction absolute position accuracy of each nozzle in the two ejecting heads 10 and a Y direction relative position accuracy of the nozzles in one ejecting head 10 and those in the other.

Also, the two eccentric cam members 15 are provided on the side of the side surface of each ejecting head 10 extending in the X direction perpendicular to the array direction of the nozzle arrays 11, and are brought into with the reference surface 13 parallel to the X direction, thereby enabling a correction of the position of the ejecting head 10 in the array direction of the nozzle arrays 11. By this means, in the array direction of the nozzle arrays 11, a physical positioning of the nozzles can be carried out with high accuracy, and ink can be mechanically ejected with high accuracy, making it possible to maintain a recording quality.

In this example, as the plurality of ejecting heads 10 can each be adjusted as to its position accuracy in the array direction of the nozzle arrays 11, a relative positioning in the nozzle arrays 11 direction, of a nozzle provided at an end portion of ejecting head 10 and a nozzle provided at an end portion of the adjacent ejecting head 10, can be reliably carried out with high accuracy. In this way, a relative positioning of a nozzle array 11 end in one of the plurality of ejecting heads 10 and the adjacent one in another can be carried out with high accuracy, making it possible to maintain a recording quality when ink is ejected from the nozzle arrays which span the plurality of ejecting heads 10.

Figure 3:
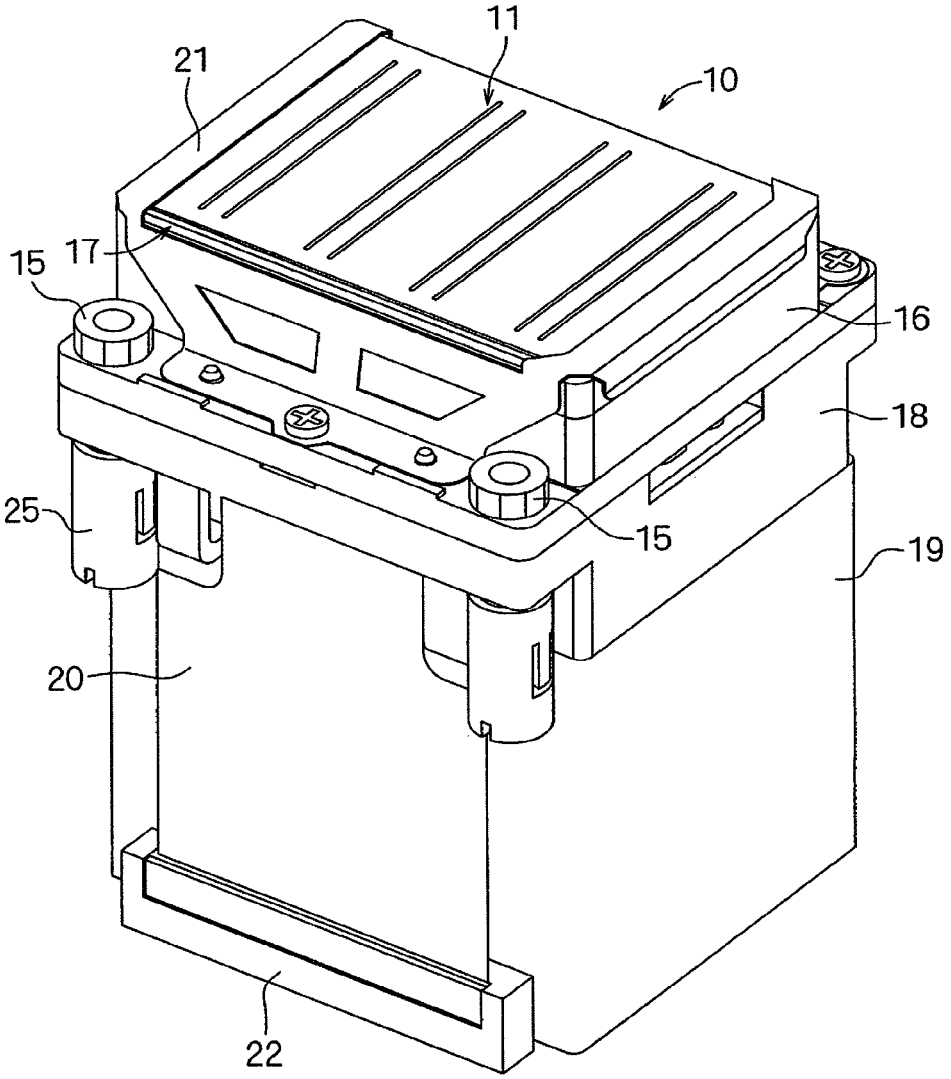
FIG. 3 is a perspective view of an ejecting head seen from a nozzle surface side.

FIG. 3 is a perspective view of the ejecting head 10 including the eccentric cam members 15, seen from the nozzle surface side.

The ejecting head 10 includes a flow channel unit 17 including a nozzle plate formed with the nozzle arrays 11, and a head casing 16 to which the flow channel unit 17 is fixed by an adhesive or the like and inside which is stored pressure generating means such as a piezoelectric vibrator. Also, the ejecting head 10 includes a filter unit 18 which, being attached to a side of the head casing 16 opposite the nozzle surface, filters ink ejected from the flow channel unit 17, and an ink supply unit 19 which supplies ink to the filter unit 18. In the figure, reference numeral 21 depicts a head cover which protects the flow channel unit 17, reference numeral 20 depicts a flexible cable 20 which supplies an ejection signal to the piezoelectric vibrator, and reference numeral 22 depicts a connector 22.

The filter unit 18 and the ink supply unit 19 are formed so as not to protrude from the outer periphery of the head casing 16 as seen from the nozzle surface side. By so doing, it is possible to increase an integration rate of the plurality of ejecting heads 10 when being mounted on the head unit 1, enabling an effective reduction in size of the head unit.

The eccentric cam members 15 are each provided in the vicinity of a corner on the side of an identical side surface of the ejecting head 10 perpendicular to the array direction of the nozzle arrays 11. By setting as long a distance as possible between the eccentric cam members 15, even in a case of using the same eccentric cam members 15, a micro adjustment is possible when a tilt of the nozzle arrays 11 is adjusted.

The eccentric cam members 15 are each configured in such a way as to rotate in conjunction with a knob member 25, and configured in such a way that the position of a cam face in contact with the reference surface 13 can be changed by holding and rotating the knob member 25 with fingers.

Figure 4:
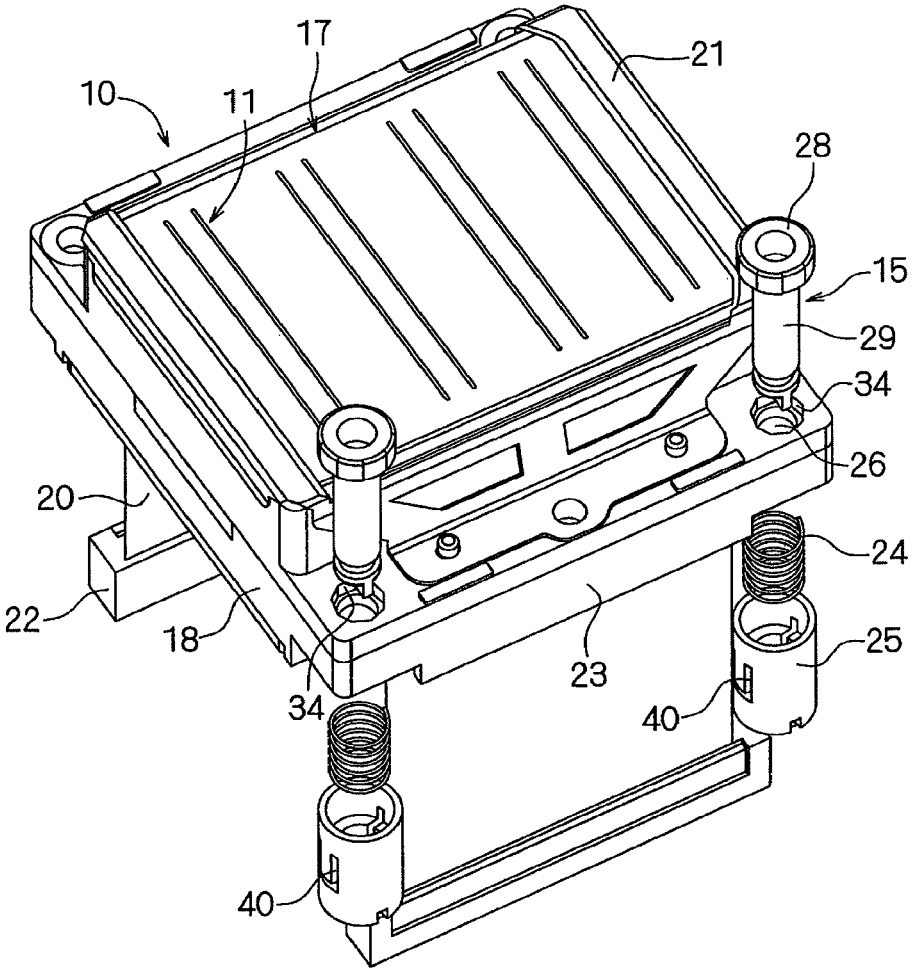
FIG. 4 is an exploded perspective view showing a correction mechanism.
Figure 5A:
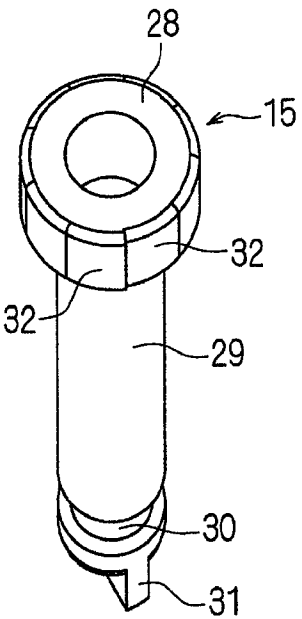
FIGS. 5A to 5D are views showing an eccentric cam member.
Figure 5B:
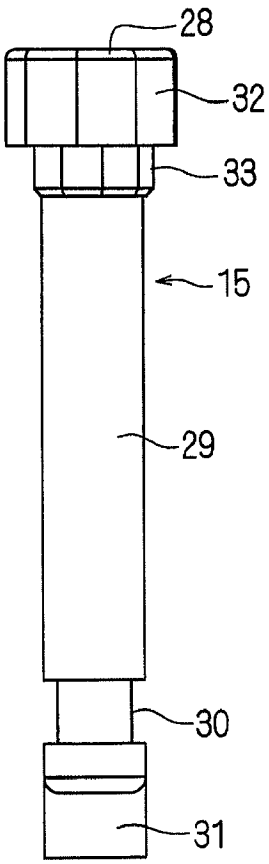
Figure 5C:
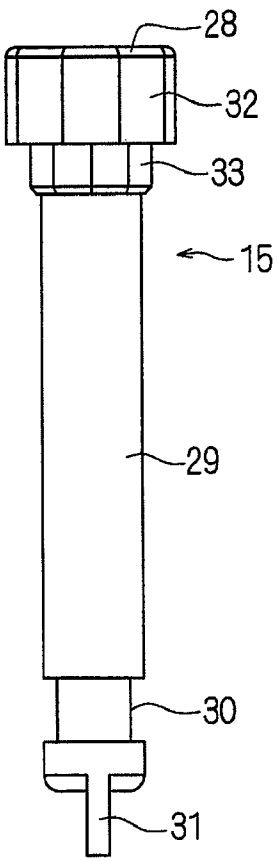
Figure 5D:
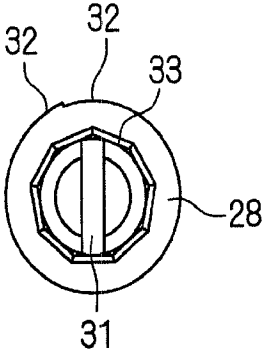

FIG. 4 is an exploded perspective view of a correction mechanism section including the eccentric cam members 15.

In each of the eccentric cam members 15, a shaft 29 extends from the lower side of a cam 28, and an attachment groove 30, which is used to attach the knob member 25, is formed in the vicinity of a lower end of the shaft 29. The shaft 29 is inserted through an attachment hole 26 which vertically penetrates the head casing 16 and a flange 23 of the filter unit 18, and a compression spring 24 is inserted through a portion of the shaft 29 which projects from the lower side of the flange 23. The knob member 25 is thus attached to the attachment groove 30 formed at the lower end of the shaft 29.

FIGS. 5A to 5D are views showing details of the eccentric cam member 15.

As described heretofore, the eccentric cam member 15 is configured to have the cam 28 formed at an upper end of the shaft 29 and the attachment groove 30 formed in the vicinity of the lower end thereof.

The cam 28 of the eccentric cam member 15 is formed as an approximate cylinder, and its periphery is formed with a plurality of (in this example, nine) stages of cam faces 32. The cam faces 32 are arc surfaces. Respective distances between the cam faces 32 and the center of the approximate cylinder are gradually varied.

Also, the eccentric cam member 15 is provided with a polygonal projection 33 for positioning the eccentric cam member 15 so as to cause each of the cam faces 32 to face the prescribed reference surface 13. The polygonal projection 33 is formed in such a way that a polygonal column, having a smaller diameter than the cam 28, projects from the lower surface of the cam 28. The shaft 29 extends from the lower surface of the polygonal projection 33. The cam 28, the polygonal projection 33 and the shaft 29 are concentrically formed with each other.

The polygonal projection 33 is a regular polygon (in this example, a regular nonagon) having the same number of faces as the number of cam faces 32 of the cam 28. A fitting recess 34, in which the polygonal projection 33 fits, is formed in an upper opening portion of the attachment hole 26 of the flange 23. In this example, the fitting recess 34 is a polygonal recess having approximately the same shape (in this example, a regular nonagon) as the polygonal projection 33. With the polygon projection 33 fitting in the fitting recess 34, a cam face 32 is positioned so as to face the reference surface 13.

Figure 6A:
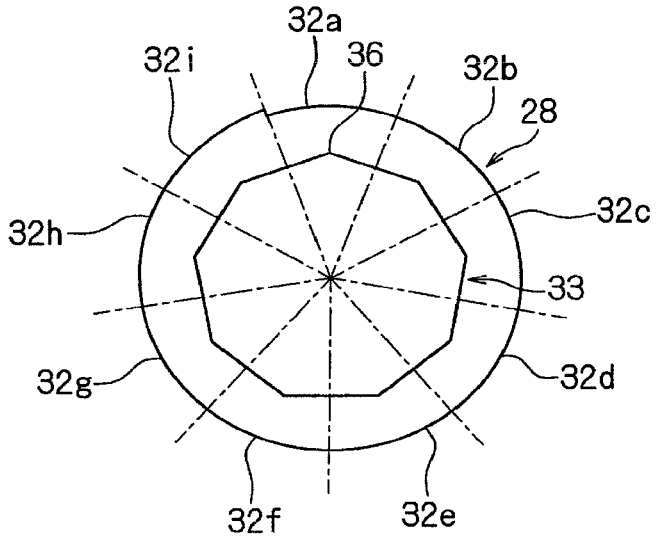
FIGS. 6A and 6B are diagrams illustrating details of a cam.

FIG. 6A is a view illustrating a positioning relationship between the cam faces 32 of the cam 28 and the polygonal projection 33. The cam 28 has nine stages of cam faces 32*a* to 32*i* in this example, and the cam faces 32*a* to 32*i* are arc surfaces, distances from which to the center are gradually varied. The polygonal projection 33 is a regular polygon having the same number of angles 36 as the number of cam faces 32*a* to 32*i*. The polygonal projection 33 is formed as a regular nonagon in this example, and the cam 28 and the polygonal projection 33 are concentrically disposed, and are disposed in such a way that the angles 36 of the polygonal projection 33 are each positioned in the center of the arc of each cam face 32*a* to 32*i*.

Figure 6B:
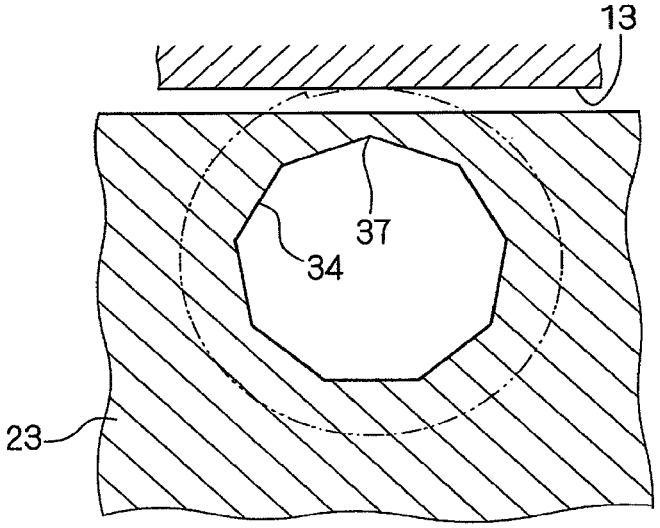

FIG. 6B is a view illustrating a positioning relationship between the fitting recess 34, in which the polygonal projection 33 fits, and the reference surface 13. The fitting recess 34 forms the same polygon, in this example, the same regular nonagon as the polygonal projection 33, and is formed in such a way that one corner 37 corresponding to an angle 36 of the polygonal projection 33, which forms the regular nonagon, faces a side surface of the ejecting head 10 which is caused to face the reference surface 13. With such a configuration, with the polygonal projection 33 fitted in the fitting recess 34, the center of the arc of each cam face 32*a* to 32*i* is configured to face the reference surface 13 (the figure shows a condition in which the cam face 32*a* is in face-to-face contact with the reference surface 13).

By rotating the cam 28 of the eccentric cam member 15 in such a way that any one of the cam faces 32*a* to 32*i* faces the reference surface 13, the polygonal projection 33 is fitted in the fitting recess 34, whereby the cam faces 32*a* to 32*i*, distances from which to the center are different from one after another, are brought into contact with the reference surface 13. Therefore, it is possible to vary a distance between the reference surface 13 and the center of the cam 28. As a result, a configuration is such that the Y direction position of the eccentric cam members 15 of the ejecting head 10 can be adjusted.

At this time, a fitting of the polygonal projection 33 and the fitting recess 34 is a fitting of the regular polygons of the same shape, thus enabling an accurate adjustment of a rotation angle. Also, as each cam face 32*a* to 32*i* has an arc surface, it follows that it is brought into linear contact with the reference surface 13. A distance between the reference surface and the center of the cam 28 can thus be accurately conformed to a curvature radius of the arc surface of each cam face 32*a* to 32*i*, enabling an accurate position adjustment.

Also, the eccentric cam members 15 are configured in such a way that the cam face 32*i*, distance from which to the center is a maximum distance, does not interfere with the reference surface 13 in a condition in which the cam face 32*a*, distance from which to the center is a minimum distance, is brought into contact with the reference surface 13, whereby preventing an erroneous position adjustment due to an unnecessary interference.

To describe by returning to FIGS. 5A to 5C, in the eccentric cam member 15, the attachment groove 30 for attaching the knob member 25 is formed in the vicinity of the lower end of the shaft 29, and a plate-like fitting piece 31 is protruded from a lower end face of the shaft 29 below the attachment groove 30.

Figure 7A:
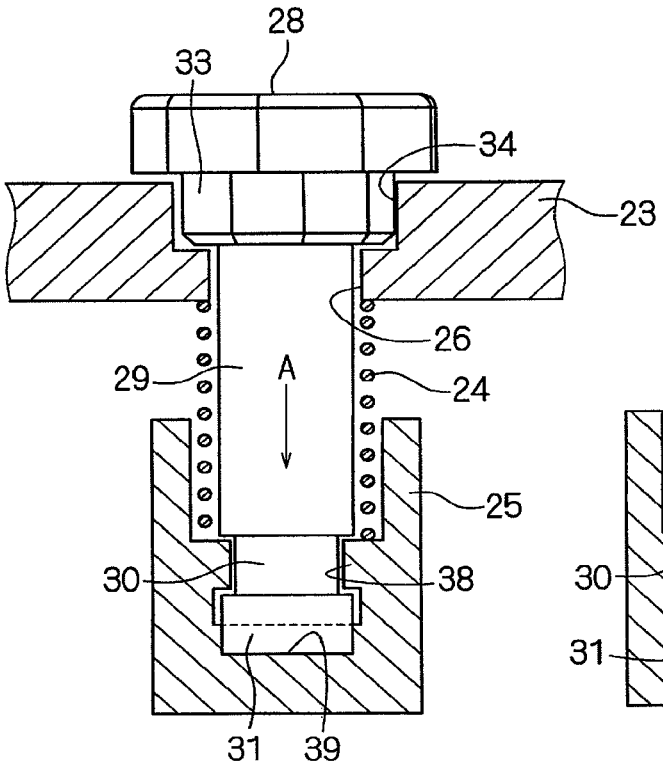
FIGS. 7A and 7B are sectional views showing the correction mechanism.
Figure 7B:
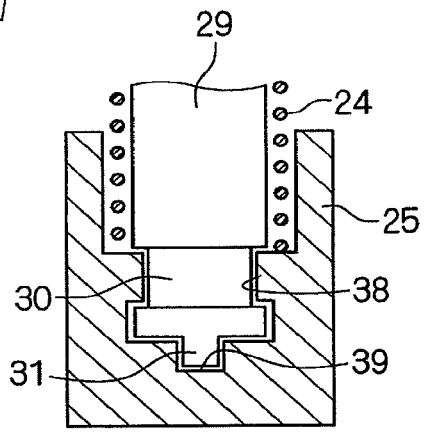

FIGS. 7A and 7B are views illustrating an attached condition of the eccentric cam member 15.

In the flange 23 of the ejecting head 10, the attachment hole 26, through which the shaft 29 is inserted, is formed in such a way as to vertically penetrate the flange 23, and the fitting recess 34 is formed in the upper opening portion of the attachment hole 26.

Meanwhile, the knob member 25 is formed into an approximately bottomed cylindrical shape, wherein a fitting projection 38, which fits in the attachment groove 30 of the eccentric cam member 15, is formed on the inner periphery of the knob member 25, while a fitting groove 39, in which is fitted the fitting piece 31 of the eccentric cam member 15, is formed in the bottom of the knob member 25. Also, a slit 40, for the purpose of facilitating a temporary elastic deformation when the fitting projection 38 is fitted in the attachment groove 30, is formed in a sidewall of the knob member 25 (refer to FIG. 4).

Then, the shaft 29 is inserted through the attachment hole 26, and the polygonal projection 33 is fitted in the fitting recess 34. In this condition, the compression spring 24 is inserted through the shaft 29 which projects from the lower side of the flange, and the fitting projection 38 of the knob member 25 is fitted in the attachment groove 30 at the lower end, thereby attaching the knob member 25.

In this condition, the upper end of the compression spring 24 is brought into contact with the lower surface of the flange 23, while the lower side of the compression spring 24 is inserted into the cylinder of the knob member 25, and the lower side of the compression spring 24 is brought into contact with the upper surface of the fitting projection 38. Then, an urging force of the compression spring 24 is applied to the flange 23 and the knob member 25, whereby the eccentric cam member 15 is imparted with a force by which it is pulled downward as seen in the figure (in the arrow A direction shown in the figure), therefore a fitting condition between the polygonal projection 33 and the fitting recess 34 is reliably maintained.

Then, in a case of rotating the eccentric cam member 15, by holding the knob member 25 with fingers or the like, and depressing the eccentric cam member 15 against the spring force of the compression spring 24, the polygonal projection 33 is disengaged from the fitting recess 34. In this condition, by rotating the eccentric cam member 15 through a prescribed angle so as to cause one stage of cam face 32 to face the reference surface 13, the polygonal projection 33 is fitted again in the fitting recess 34. By so doing, the cam face 32 in contact with the reference surface 13 is changed, thereby carrying out the Y direction position adjustment of the center of the eccentric cam member 15.

Figure 8A:
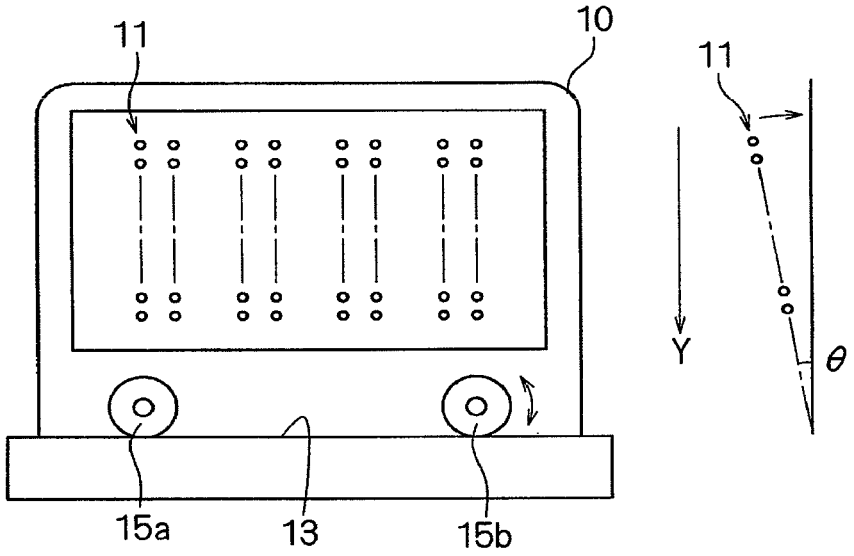
FIGS. 8A and 8B are diagrams showing a correction method.
Figure 8B:
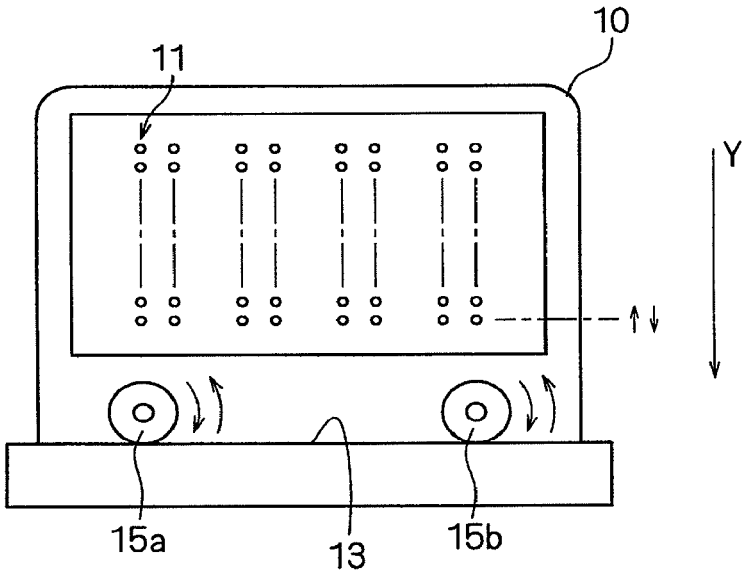

FIGS. 8A and 8B are views illustrating a position adjustment method of the ejecting head 10 using two eccentric cam members 15.

First, as shown in FIG. 8A, both right and left eccentric cam members 15*a* and 15*b* are each adjusted in such a way that the central (for example, the fifth stage of) cam face 32*e* of the nine stages of faces is brought into contact with the reference surface 13, and each is brought into contact with the reference surface 13. Subsequently, with the left eccentric cam member 15*a* remaining intact, only the right eccentric cam member 15*b* is adjusted as to its rotation, and the Y direction position of the right eccentric cam member 15*b* (that is, a distance between the reference surface 13 and the center of the eccentric cam member 15*b*) is adjusted.

This makes it possible to adjust an angle θ of each nozzle array 11 with respect to the Y direction, and the right eccentric cam member 15*b* is adjusted as to its rotation in such a way that each nozzle array 11 is made parallel to the Y direction.

Next, as shown in FIG. 8B, after a tilt adjustment of the nozzle arrays 11 is completed, the right and left eccentric cam members 15*a* and 15*b* are each adjusted as to their rotation in the same direction and through the same angle. By this means, the Y direction positions of the right and left eccentric cam members 15*a* and 15*b* (that is, the distances between the reference surface 13 and the centers of the eccentric cam members 15*a* and 15*b*) are adjusted, and with the adjusted tilt of the nozzle arrays 11 being maintained, the Y direction absolute position of each nozzle array 11 is adjusted.

Such an adjustment is carried out in each ejecting head 10, thereby making it possible to obtain the head unit 1 in which the relative position of the plurality of ejecting heads has been accurately determined and adjusted.

Figure 9:
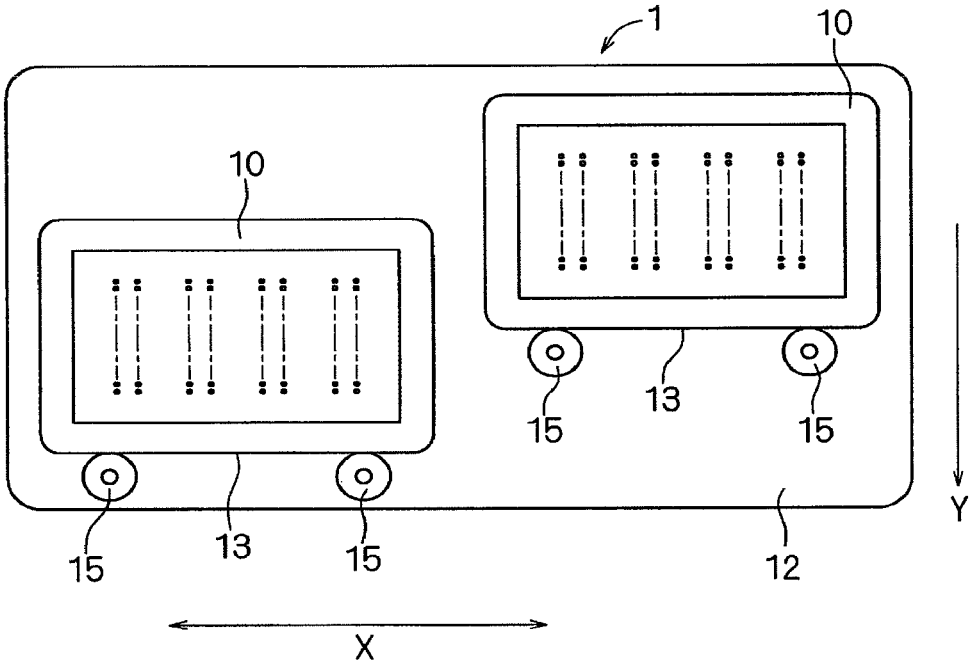
FIG. 9 is a schematic configuration diagram showing a second example of the recording head to which the invention is applied.

FIG. 9 shows a second example of the recording apparatus applying the invention.

This example is not one in which, as in the first example, the reference surface 13 is provided on the base member 12 of the head unit 1, and the eccentric members 15 are attached to the ejecting head 10, but one in which a correction mechanism including the eccentric cam members 15 is provided on the base member 12, and a side surface of the ejecting head 10 along the X direction is used as the reference surface 13. Other than that, this example is the same as the first example, and provides the similar advantageous effects.

Figure 10:
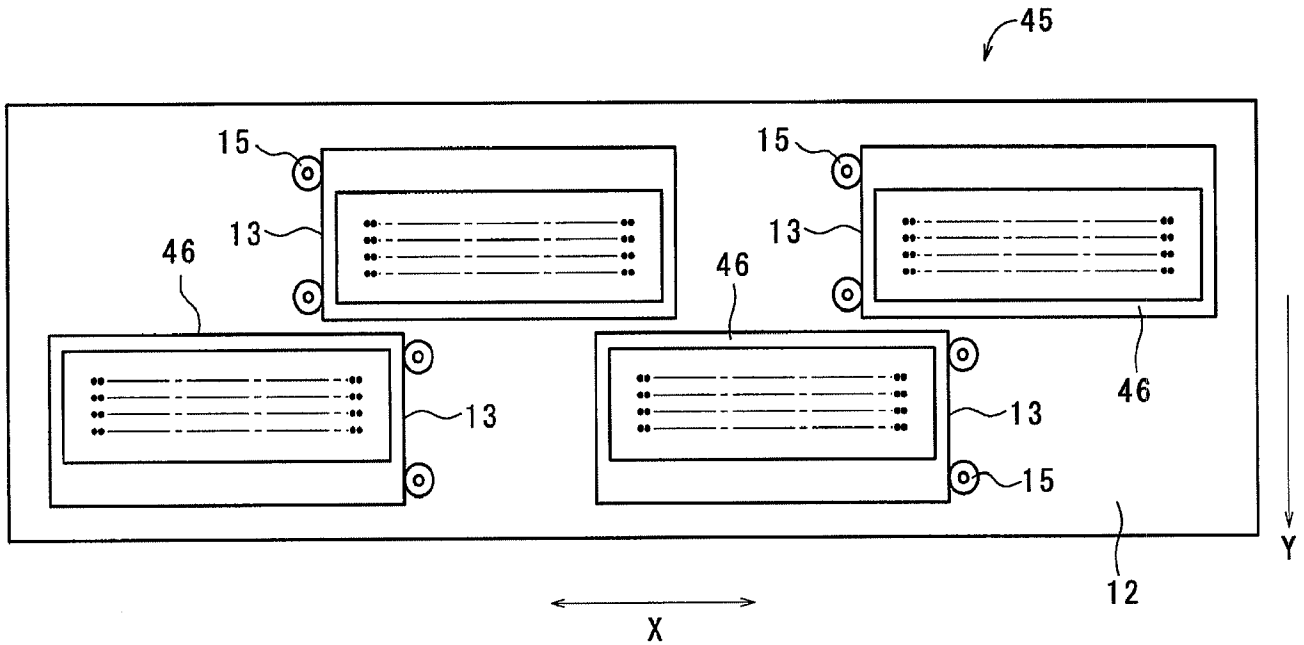
FIG. 10 is a schematic configuration diagram showing a third example of the recording head to which the invention is applied.

FIG. 10 shows a third example of the recording apparatus applying the invention.

This example is one which is applied to a line head 45 in which a multiplicity of nozzles is arranged all over the width of an ejecting area. That is, this example is not a recording apparatus which ejects ink droplets while moving the head unit 1 in the paper width direction (X direction) by means of the carriage 3, but a recording apparatus which uses the line head 45 which, having nozzles arranged in the paper width direction, ejects ink droplets for recording without moving the line head 45 in the X direction but simply by carrying out a paper feed.

FIG. 10 is a view of the line head 45 seen from the nozzle surface side. The line head 45 is configured by unit heads 46, each having a prescribed number of nozzles, being disposed side by side in the paper width direction (X direction). The unit heads 46 are each formed with nozzle arrays 11 in which nozzles of yellow (Y), magenta (M), cyan (C) and black (B) color inks are arrayed in the paper width direction. The nozzles are arrayed at a pitch P corresponding to a prescribed resolution (dot pitch). Regarding a dot pitch for an ink with which a recording paper is printed, in order to narrow a line direction (paper width direction) pitch, the nozzles of each color may be staggered in their array direction.

Also, the nozzles are arrayed in such a way that hues become paler on an upstream side in the paper feed direction shown by arrow Y than on a downstream side. This reduces an effect on an ink ejected after the previously ejected ink.

A plurality of (in this example, four) unit heads 46 is disposed in a staggered manner, wherein the overall configuration of the line head 45 is such that the nozzles of each color are provided at the prescribed pitch P over at least the same width as that of the widest paper that the apparatus can transport. That is, the unit heads 46 are disposed in such a way that a distance between a nozzle provided at an end portion of a unit head 46 and a nozzle provided at an end portion of the adjacent unit head 46 is the pitch P corresponding to the dot pitch.

Without the line head 45 scanning, ink is ejected from necessary nozzles in response to image information, and an image corresponding to the image information is printed on the recording paper. A transport speed of the recording paper is determined by a printing resolution of the apparatus, that is, a volume of ink droplets and a cycle of ink ejection timing. Consequently, the recording paper is constantly transported without a stop, thus enabling a high-speed printing.

In the line head 45, the correction mechanism including the eccentric cam members 15 is provided on the base member 12, and a side surface of each unit head 46 along the Y direction is used as the reference surface 13. The two eccentric cam members 15 are provided on the side of the side surface of each unit head 46 extending in the Y direction perpendicular to the array direction of the nozzle arrays 11, and are brought into contact with the reference surface 13 parallel to the Y direction. This enables a position correction of the unit heads 46 in the array direction of the nozzle arrays 11 (the paper width direction; the X direction). By this means, in the array direction of the nozzle arrays 11, a physical positioning of the nozzles can be carried out with high accuracy, and ink can be mechanically ejected with high accuracy, making it possible to maintain a recording quality.

In this example, it is possible to adjust the plurality of unit heads 46 as to their position accuracy in the array direction of the nozzle arrays 11. Therefore, a nozzle array 11 direction positioning, of a nozzle provided at an end portion of a unit head 46 and a nozzle provided at an end portion of the adjacent unit head 46, can be reliably carried out with high accuracy. In this way, a relative positioning of a nozzle array 11 end in one of the plurality of unit heads 46 and the adjacent one in another can be carried out with high accuracy, making it possible to maintain a recording quality when ink is ejected from the nozzle arrays which span the plurality of unit heads 46.

Also, in this example, as shown in the first example, a configuration may be such that a correction mechanism including the eccentric cam members 15 is provided in each unit head 46, in which a position adjustment is carried out by bringing the eccentric cam members 15 into contact with reference surfaces each of which is provided so as to extend in the paper feed direction (Y direction).

Figure 11:
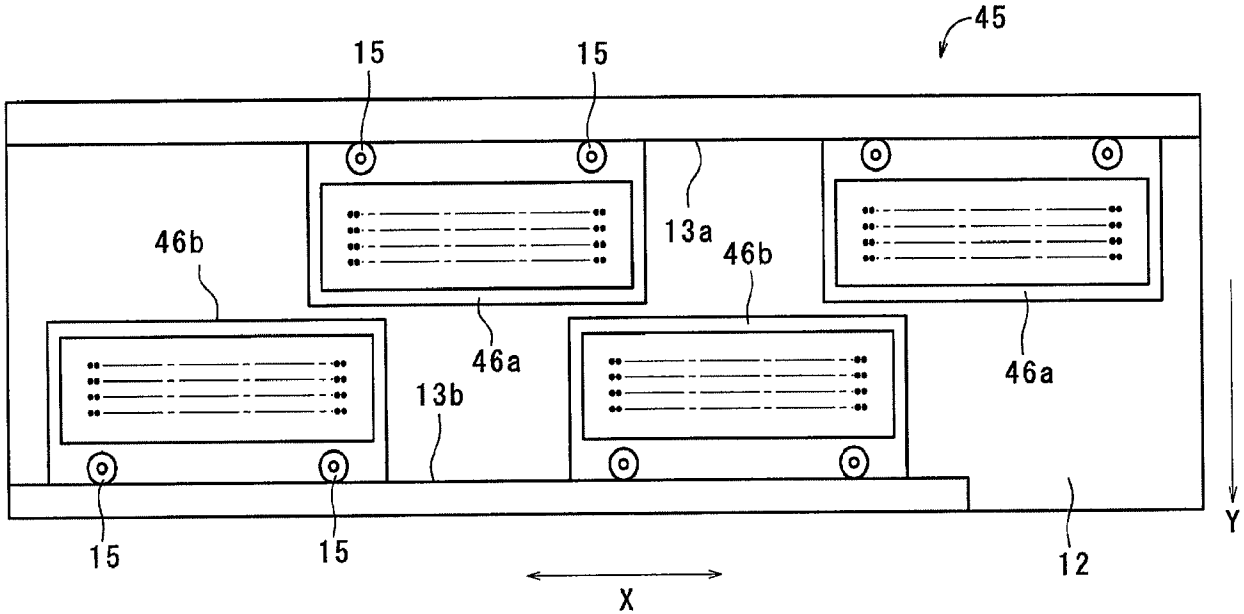
FIG. 11 is a schematic configuration diagram showing a fourth example of the recording head to which the invention is applied.
Figure 12:
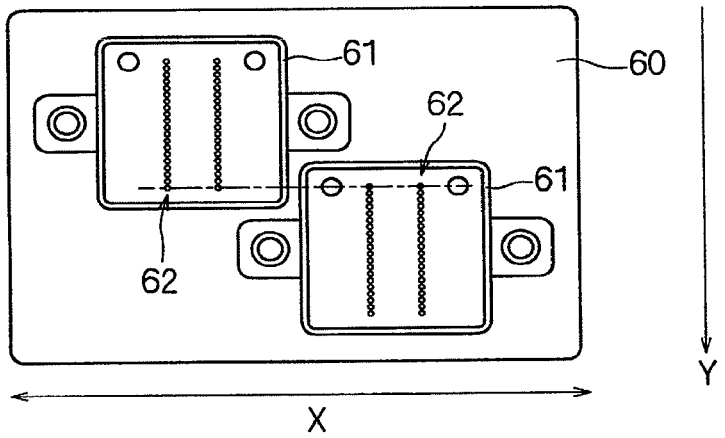
FIG. 12 is a view showing a related example.

FIG. 11 shows a fourth example of the recording apparatus applying the invention.

This example is one which is applied to a line head 45 in which a multiplicity of nozzles is arranged all over the width of an ejecting area. That is, this example is not a recording apparatus which ejects ink droplets while moving the head unit 1 in the paper width direction (X direction) by means of the carriage 3, but a recording apparatus which uses the line head 45 which, having nozzles arranged in the paper width direction, ejects ink droplets for recording without moving the line head 45 in the X direction but simply by carrying out a paper feed.

FIG. 11 is a view of the line head 45 seen from the nozzle surface side. The line head 45 is configured by unit heads 46, each having a prescribed number of nozzles, being disposed side by side in the paper width direction (X direction). The unit heads 46 are each formed with nozzle arrays 11 in which nozzles of yellow (Y), magenta (M), cyan (C) and black (B) color inks are arrayed in the paper width direction. The nozzles are arrayed at a pitch P corresponding to a prescribed resolution (dot pitch). Regarding a dot pitch for an ink with which a recording paper is printed, in order to narrow a line direction (paper width direction) pitch, the nozzles of each color may be staggered in their array direction.

Also, the nozzles are arrayed in such a way that hues become paler on an upstream side in the paper feed direction shown by arrow Y than on a downstream side. This reduces an effect on an ink ejected after the previously ejected ink.

A plurality of (in this example, four) unit heads 46 is disposed in a staggered manner, wherein the overall configuration of the line head 45 is such that the nozzles of each color are provided at the prescribed pitch P over at least the same width as that of the widest paper that the apparatus can transport. That is, the unit heads 46 are disposed in such a way that a distance between a nozzle provided at an end portion of a unit head 46 and a nozzle provided at an end portion of the adjacent unit head 46 is the pitch P corresponding to the dot pitch.

Without the line head 45 scanning, ink is ejected from necessary nozzles in response to image information, and an image corresponding to the image information is printed on the recording paper. A transport speed of the recording paper is determined by a printing resolution of the apparatus, that is, a volume of ink droplets and a cycle of ink ejection timing. Consequently, the recording paper is constantly transported without a stop, thus enabling a high-speed printing.

In the line head 45, reference surfaces 13*a* and 13*b* are formed on an upstream and a downstream side in the recording paper transport direction (Y direction), respectively. The staggered unit heads 46 are configured in such a way that a plurality of unit heads 46*a* disposed on the upstream side is positioned by bringing the eccentric cam members 15 into contact with one reference surface 13*a* on the upstream side, while a plurality of unit heads 46*b* disposed on the downstream side is positioned by bringing the eccentric cam members 15 into contact with one reference surface 13*b* on the downstream side. Other than that, the fourth example is the same as the first example, and provides the similar advantageous effects.

Also, in this example, as shown in the second example, a configuration can also be such that a correction mechanism including the eccentric cam members 15 is provided on the base member 12, wherein a side surface of each unit head 46 along the X direction is used as the reference surface 13.

According to the above configurations, in the invention, two correction members for correcting a position of the ejecting head 10 by being brought into contact with a prescribed reference surface 13, are provided in line on the side of one side surface of the ejecting head 10, spaced a prescribed distance each other, the two correction members enabling a positioning of the nozzles in a nozzle surface direction. Consequently, by adjusting one of the two correction members with the other fixed, it is possible to adjust a tilt of the nozzle arrays 11 of the ejecting head 10. Then, after the tilt is determined, the two correction members are adjusted in the same manner, thereby making it possible to adjust the absolute position of the ejecting head 10 while maintaining the tilt of the nozzle arrays 11. In this way, regarding both the tilt of the nozzle arrays 11 and the absolute position of the ejecting head 10, a highly accurate positioning can be realized by a simple structure and operation.

Also, the two correction members, being provided on the side of a side surface perpendicular to a transport direction of the target object, correct a position of the ejecting head 10 in the transport direction of the target object. In this case, in the transport direction of the target object in which an electrical correction is substantially difficult, a physical positioning of the nozzles can be carried out with high accuracy, and a liquid can be mechanically ejected with high accuracy, making it possible to maintain an ejecting quality.

In addition, the two correction members, being provided on the side of a side surface perpendicular to an array direction of the nozzle array 11, correct a position of the ejecting head 10 in the array direction of the nozzle array 11. In this case, in the array direction of the nozzle arrays 11, a physical positioning of the nozzles can be carried out with high accuracy, and a liquid can be mechanically ejected with high accuracy, making it possible to maintain an ejecting quality. For example, in a plurality of ejecting heads, a relative positioning of a nozzle end in one of a plurality of ejecting heads and the adjacent one in another can be carried out with high accuracy, making it possible to maintain an ejecting quality when a liquid is ejected from the nozzle arrays which span the plurality of jet heads.

Furthermore, a head unit 1 including a plurality of the ejecting heads 10 is provided, in which the ejecting heads 10 configuring the head unit 1 are each provided with two correction members. Therefore, a relative position of the plurality of ejecting heads 10 configuring the head unit 1 can be mechanically determined with high accuracy.

Further still, the correction members are each an eccentric cam member 15 which, having a plurality of stages of cam faces 32, is gradually varied in a distance from the center to each of the cam faces 32, and the eccentric cam member 15 is provided with a positioning portion for positioning the eccentric cam member 15 so as to cause each of the cam faces 32 to face a prescribed reference surface 13. Therefore, an adjustment is possible by the positioning portion causing a desired cam face to face the reference surface 13, so that a tilt of the nozzle arrays 11 can also be adjusted by a simple operation, and after the tilt of the nozzle arrays has been adjusted, a similar adjustment of the absolute position of the ejecting head 10 by means of the two correction members can also be reliably carried out by a very simple operation.

Also, the positioning portion, which is a polygonal projection 33 having the same number of faces as the number of cam faces 32, is configured in such a way as to position the cam faces 32 with the polygonal projection 33 fitting in a fitting recess 34. Therefore, each cam face 32 accurately faces the reference surface 13 simply by fitting the polygonal projection 33 in the fitting recess 34. Moreover, an adjustment operation can be carried out by only changing a rotation angle when the polygonal projection 33 is fitted in the fitting recess 34. Therefore, a positioning operation can be very easily carried out with high accuracy.

In addition, the fitting recess 34 is a polygonal recess having approximately the same shape as the polygonal projection 33. Therefore, in fitting the polygonal projection 33 in the fitting recess 34, the polygonal projection 33 is rotated for each angle, and the cam faces 32 are displaced one by one, thereby enabling an easy and reliable adjustment.

Furthermore, each of the cam faces 32*a* to 32*i* is an arc surface having the center of the polygonal projection 33 as its center. Therefore, it follows that the cam faces 32*a* to 32*i* are brought into linear contact with the reference surface 13, respectively. A distance between the reference surface 13 and the center of the cam 28 can thus be accurately conformed to a curvature radius of the arc surface of each cam face 32*a* to 32*i*, enabling an accurate position adjustment.

Further still, the eccentric cam members 15 are configured in such a way that the cam face 32*i* having a maximum distance from the center does not interfere with the prescribed reference surface 13 in a condition in which the cam face 32*a* having a minimum distance from the center is in contact with the prescribed reference surface 13. Therefore, as an unnecessary interference does not occur, no trouble with an adjustment operation occurs, making it possible to carry out a reliable adjustment.

The invention can be applied to a liquid ejecting apparatus, and as its representative example, there is an inkjet recording apparatus equipped with an inkjet recording head for image recording. Other examples of the liquid ejecting apparatus include an apparatus equipped with a color material ejecting head for use in manufacturing a color filter for a liquid crystal display or the like, an apparatus equipped with an electrode material (electrically conductive paste) ejecting head for use in forming an electrode for an organic light emitting display, a surface emitting display (FED) or the like, an apparatus equipped with a living organic material ejecting head for use in manufacturing biochips, an apparatus equipped with a sample ejecting head as a precision pipette, and the like.

What is claimed is:

1. A head unit comprising:

a base extended in a first direction;

a first head fixed to the base, the first head comprising a nozzle array extended in the first direction;

a second head fixed to the base, the second head comprising a nozzle array extended in the first direction, the second head configured to print continual dots with the first head;

a first corrector configured to rotate and adjust an angle of the first head with respect to the base, the first corrector disposed at a first side in a second direction orthogonal to the first direction with respect to the first head; and a second corrector configured to rotate and adjust an angle of the second head with respect to the base, the second corrector disposed at a second side opposite to the first side in the second direction with respect to the second head, wherein the first head is configured to print first dots with a dot pitch in the first direction, the second head is configured to print second dots with the dot pitch in the first direction, the first dots and the second dots are configured to form a line with the dot pitch in the first direction, and the first and second heads are disposed between the first and second correctors in the second direction.

2. The head unit according to claim 1, wherein the first corrector is configured to apply a force toward the second side to adjust the angle of the first head.

3. A liquid ejecting apparatus comprising the head unit according to claim 1 and the base.

4. The head unit according to claim 2, wherein the second corrector is configured to apply a force toward the first side to adjust the angle of the second head.

5. The head unit according to claim 4, wherein the first and second correctors have substantially the same shape.

6. The head unit according to claim 1, wherein the base comprises a side surface configured to contact with the first corrector and another side surface configured to contact with the second corrector.

7. The head unit according to claim 6, wherein the side surfaces extend in the first direction.

8. The head unit according to claim 1, further comprising:

a third head fixed to the base, the third head comprising a nozzle array extended in the first direction, the third head configured to print continual dot with the second head; and a third corrector configured to rotate and adjust an angle of the third head with respect to the base, the third corrector disposed at the first side in the second direction with respect to the third head, wherein the third head is configured to print third dots with the dot pitch in the first direction, the first, second and third dots are configured to form a line with the dot pitch in the first direction, the first, second and third heads are disposed between the first and second correctors in the second direction, and the first, second and third heads are disposed between the third and second correctors in the second direction.

9. The head unit according to claim 1, wherein each of the first and second heads has nozzle arrays each configured to eject a different color ink.

10. The head unit according to claim 1, wherein the base comprises a first and a second reference surfaces spaced apart from each other in the second direction, wherein the first reference surface is configured to contact with the first corrector, and the second reference surface is configured to contact with the second corrector.

11. The head unit according to claim 8, wherein the base comprises a first and a second reference surfaces spaced apart from each other in the second direction, wherein the first reference surface is configured to contact with the first and third correctors, and the second reference surface is configured to contact with the second corrector.

12. The head unit according to claim 1, wherein the first corrector is disposed within a range corresponding to a length of the nozzle array of the first head in the first direction, and the second corrector is disposed within a range corresponding to a length of the nozzle array of the second head in the first direction.

* * * * *